US007127870B2

(12) United States Patent
McRay et al.

(10) Patent No.: US 7,127,870 B2
(45) Date of Patent: Oct. 31, 2006

(54) REPLACEMENT LOCK LEVER FOR AN AUTOMATIC BEVERAGE FILLING MACHINE

(75) Inventors: Cecil R. McRay, Salt Lake City, UT (US); Michael D. Nish, Salt Lake City, UT (US); Terry E. Nish, Salt Lake City, UT (US)

(73) Assignee: Servi-Teck, INC, Salt Lake City, UT (US)

( * ) Notice: Subject to any disclaimer, the term of this patent is extended or adjusted under 35 U.S.C. 154(b) by 0 days.

(21) Appl. No.: 10/449,587

(22) Filed: May 30, 2003

(65) Prior Publication Data

US 2004/0237477 A1 Dec. 2, 2004

(51) Int. Cl.
*B65B 31/02* (2006.01)

(52) U.S. Cl. ..... 53/79; 53/84; 53/90; 53/253; 141/147; 141/150

(58) Field of Classification Search ..... 53/253, 53/432, 79, 84, 90, 398, 403, 407; 141/144, 141/147, 150, 39–43, 165
See application file for complete search history.

(56) References Cited

U.S. PATENT DOCUMENTS 2,519,353 A * 8/1950 Cassady ..... 53/407
2,822,943 A * 2/1958 Fedorchak ..... 53/317
2,958,346 A * 11/1960 Kerr ..... 141/147
3,040,787 A * 6/1962 Knoll ..... 141/147
3,245,436 A * 4/1966 Burgert, Jr. ..... 141/165
3,826,293 A * 7/1974 Cayton ..... 141/144
4,522,238 A * 6/1985 Minard ..... 141/147
4,643,141 A * 2/1987 Bledsoe ..... 123/90.16
4,721,200 A * 1/1988 Dugan ..... 141/145
4,918,902 A * 4/1990 Honma et al. ..... 53/432
5,042,536 A * 8/1991 Petri et al. ..... 141/39
5,145,008 A * 9/1992 Yun ..... 141/39
5,189,928 A * 3/1993 Ontrop et al. ..... 74/603
5,351,576 A * 10/1994 Matsui et al. ..... 74/600
5,413,153 A * 5/1995 Zwilling et al. ..... 141/39
5,469,899 A * 11/1995 Nish ..... 141/148
5,642,764 A * 7/1997 Nish ..... 141/392
5,865,070 A * 2/1999 Bornhorst et al. ..... 74/603
6,263,925 B1 * 7/2001 Olsen ..... 141/156
6,415,754 B1 * 7/2002 Hirano et al. ..... 123/90.43
6,647,869 B1 * 11/2003 Bornhorst et al. ..... 100/257

OTHER PUBLICATIONS

Date unknown, but has existed commercially for many years—Drawing.

* cited by examiner

*Primary Examiner*—Stephen F. Gerrity
*Assistant Examiner*—Hemant M. Desai
(74) *Attorney, Agent, or Firm*—Lynn G. Foster

(57) ABSTRACT

Replacement lock levers and related methods are disclosed which accommodate adjustment to acceptable tolerances of the force applied to cans being filled by the platform lift cylinder assemblies of the automatic beverage filling machine, due to an eccentricity of the replacement lock levers.

5 Claims, 5 Drawing Sheets

REPLACEMENT LOCK LEVER FOR AN AUTOMATIC BEVERAGE FILLING MACHINE

FIELD OF THE INVENTION

The present invention relates generally to lock levers in automated beverage can filling machines and to related methods and more particularly to replacement selectively rotatable eccentrically adjustable lock levers and to related methods, each replacement lock lever having an inactive position wherein the eccentric nature thereof accommodates variation in the elevation of a surface when in the active position to insure application of a force to a bottom surface of a platform lift cylinder assembly to set the force or pressure applied by the lift cylinder assembly to the lip of a can being filled with beverage so that damage to the can is reduced.

BACKGROUND

Cans containing a beverage, such as carbonated soft drinks and beer, have been reconfigured progressivley over the past several years to save aluminum thereby saving millions of dollars annually. The saving in aluminum has been in the form of thinner can walls and a necked down or tapered top defining a reduced diameter opening terminating in a top edge or lip.

The reduced diameter top edge or lip forceably engages a sealing rubber or gasket under a force imposed by a platform left cylinder assembly at the time the open top can being filled in an automatic beverage filling machine. The sequential steps in filling, as the filling portion of the machine turns, are: first charging the open top can with carbon dioxide to counter pressure the can, introduction of a controlled amount of beverage from a storage location, such as an elevated bowl, and snifting the beverage containing can. The lid is thereafter placed in sealed relation with the top of the can.

With the thinner side walls, the tapered top and the smaller top opening in modern day cans has come a significant increase in the number of cans damaged during the filling process. Typically, the necked down or tapered top of the can sometimes buckles, crimps or crinkles due to excessive force or over clamp on the can. These damaged cans and the beverage therein are discarded, making the manufacturing costs higher.

The aforementioned can damage problem has persisted for a relatively long time, without a solution until the present invention.

BRIEF SUMMARY AND OBJECTS OF THE PRESENT INVENTION

In brief summary, the present invention overcomes or substantially eliminates the aforesaid can damage problem. Novel replacement lock levers and related methods are provided which accommodate adjustment to acceptable tolerances of the force applied to cans being filled by the platform lift cylinder assemblies of the automatic beverage filling machine, due to an eccentricity of the replacement lock levers.

With the foregoing in mind, it is a primary object of the present invention to overcome or alleviate the can damage problem mentioned above.

Another paramount object is the provision of novel lock levers and related methods.

A further significant object is the provision of novel replacement lock levers, and related methods, which replacement lock levers accommodate adjustment to acceptable tolerances of the force applied by platform lift cylinder assemblies to cans as the cans are being filled.

An additional object of value is the provision of novel eccentric lock levers and related methods by which the force applied by platform lift cylinder assemblies is individually adjusted to be within acceptable tolerances to deduct damage to cans.

These and other objects and features of the present invention will be apparent from the detailed description taken with reference to accompanying drawings.

DETAILED DESCRIPTION OF THE ILLUSTRATED EMBODIMENTS

Figure 1:
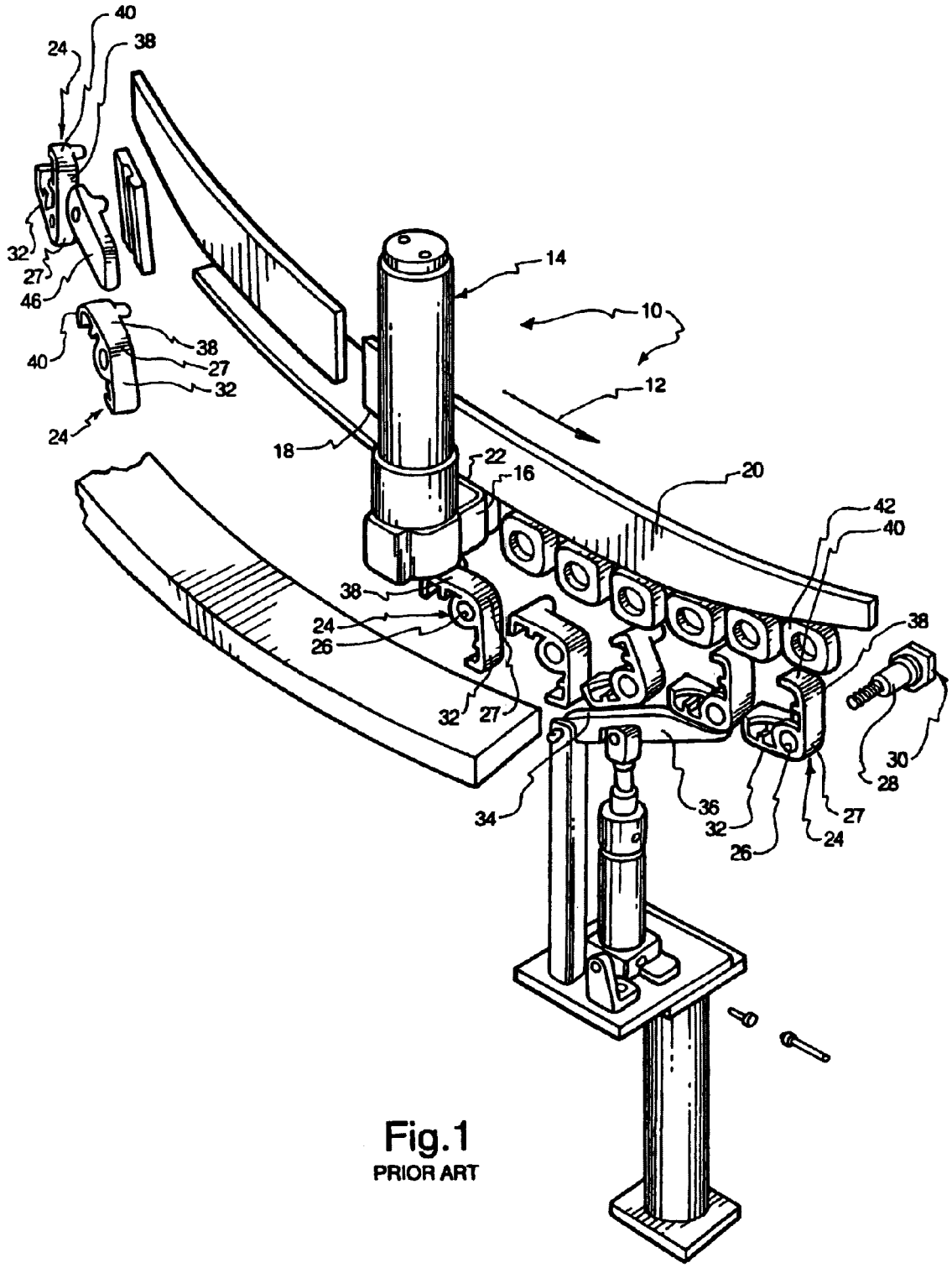
Fig.1 PRIOR ART
FIG. 1 is a fragmentary and somewhat diagrammatic perspective of part of an automatic beverage filling machine.

Automatic beverage filling machines have long existed and are used at extraordinarily high speeds to produce canned beverages, both beer and carbonated soda pop. Because automatic beverage filling machines are extremely costly to capitalize, few new installations take place. Instead, the standard in the industry is to repair including replacement of parts periodically, when the automatic beverage filling machine is idle for a periodic inspection.

In the course of time, with wear and tear as well as non-adjustments and maladjustments, cans being filled are sometime held in place with too little force and often with too much force imposed by the platform lift cylinder assembly.

In addition, the industry has seen fit to eliminate a small amount of aluminum from each can. This saves, collectively, many millions of dollars in aluminum costs in a year's time. This has been done by necking down the top, which reduces the diameter of the top opening at an upper lip or edge of the can resulting in a necked-down transition wall segment between the lip and the full diameter outside cylindrical wall of the can. Because the wall of such cans is so thin, forces over a certain magnitude will damage the wall. This is particularly true with the necked-down wall portion of the cans because the forces imposed on the can create an eccentric moment or a torque at the necked-down section, causing crinkling or buckling.

To prevent such crinkling or buckling at the necked-down portion of the cans of the type presently being used, the amount of force imposed by the platform lift cylinder assembly must be set within certain tolerances or limits. Similarly, in order to prevent separation of the lip of the can being filled with beverage and the superimposed fill seal in the automatic beverage filling machine, the upward force imposed by the platform lift cylinder assembly must be of a predetermined minimum. Otherwise, separation occurs at the fill seal and counter pressure $CO_2$ or beverage under pressure is discharged, between the fill seal and the lip of a can into a region adjacent to the machine.

Conventional lock levers rotate concentrically, are incapable of adjustment of the leg which engages the bottom of a platform lift cylinder assembly when the lock lever is in its active position, as opposed to its inactive position. Each lock lever when in its active position is designed, among other things, to prevent the upper lip of a can during filling from separating from the seal above the lip. Without lock levers, the force of the counter pressure $CO_2$ and/or the beverage placed in the can during the filling operation would displace the associated lift cylinder assembly downward allowing separation between the lip of the can and the superimposed fill seal. The amount of influent fluid forces into the can exceed the oppositely directed spring bias imposed upon the lift cylinder assembly, which means without the lock levers the fill seal would not prevent leakage across the lip of the can.

Heretofore, the only solution available in the industry to imposition of excessive forces upon cans being filled with beverage by reason of the relationship between each lift cylinder assembly and its associated lock lever was to replace the lock levers, removing the old ones and replacing them with new ones of the same type. However, with wear and tear, replacement of the standard concentric lock levers did not always solve the problem and, as a consequence, with reduced diameters in the upper opening of cans, there has come to be an excessively large number of cans which are damaged during filling and must be discarded because the necked-down region crinkles or buckles.

The present invention provides a solution to the aforementioned long-standing problem for which the industry has previously found no solution. Novel replacement lock levers, which have an eccentric adjustment feature by which the elevation is adjusted, and related methods, are provided. The adjustment of each eccentric lock lever in respect to its associated lift cylinder assembly is accommodated so that forces imposed upon cans being filled with beverage in an automatic beverage filling machine are kept within acceptable tolerances thereby substantially alleviating the above-mentioned can crinkling and buckling problem. The elevation of each replacement lock lever, when in the active position, is individually adjustable in terms of the elevation of an engagement surface which is placed contiguous with the bottom of the cylinder assembly.

Reference is now made to the drawings, wherein like numerals are used to designate like parts throughout. Specific reference is made to FIG. 1 which is a fragmentary perspective representation of an automatic beverage filling machine, generally designated 10, with parts removed for clarity of illustration. The machine 10 of FIG. 1 is well understood by those skilled in the art and, therefore, an exhaustive description is not necessary.

The machine 10 rotates as indicated by arrow 12. It comprises a plurality of platform lift cylinder assemblies, generally designated 14, only one of which is illustrated. Mounted on top of each platform lift cylinder assembly 14 is a lift platform (not shown in FIG. 1) upon which a can to be filled is placed, and a backrest (not shown in FIG. 1) above the lift platform against which the lower part of the cylindrical wall of the can is contiguously engaged to provide and return proper alignment of the can with the fill head. The assemblies comprising a cylinder 14, a lift platform and a backrest are conventional.

With continued reference to FIG. 1, the cylinders 14 are arranged sequentially (successively) and turn as an array as the automatic beverage filling machine 10 turns. Each platform lift cylinder assembly 14, is spring loaded so that the cylinder assembly 14 is urged in an upward direction. To receive an empty open top can to be filled, a lift platform cylinder assembly 14 must be lower. This is accomplished by lowering the assembly 14 due to engagement between the offset base 16 of the cylinder 14 and a lower surface 18 of a stationary curvilinear cam 20. This engagement is along interface 22. The engagement at interface 22 holds the cylinder assembly 14 down counter to its spring load, allowing an empty can to be inserted upon the associated lift platform against the associated backrest.

During the interval when the cylinder 14 is held down by engagement at interface 22, the associated conventional concentric lock lever 24 is in its inactive position, having rotated to that position around aperture 26 thereof, which receives a smooth cylindrical portion 28, of a shoulder bolt 30. Thus, when the lock lever 24 is positioned as shown immediately below the cylinder 14 depicted in FIG. 1, there is no contact between the lock lever 24 and the base of the cylinder.

However, as the machine 10 continues to turn, leg 32 engages the top surface 34 of a stationary cam 36, rotating the concentric lock lever 24 clockwise through about 90 degrees from the position shown centrally in FIG. 1 to the position shown at the right in FIG. 1. In this position, leg 32 is horizontally disposed, the leg 38 is vertically disposed and an engagement surface 40 of the leg 38 is horizontally disposed. Engagement surface 40, in the position shown in FIG. 1, extreme right, engages the bottom surface of an offset base element 42 of the cylinder assembly 14. The elevation of engagement surface 40 controls the amount of force the cylinder 14 imposes upon the can.

By the time the cylinder 14 moves from the central position illustrated in FIG. 1 to the right-hand most position of FIG. 1, engagement at interface 22 has discontinued, and the spring force of cylinder 14 (with an empty can on its platform) has elevated the cylinder 14 such that the lip of the empty can engages a filling seal superimposed above the lip of the can. Thereafter, the filling procedure takes place and the lip 61 of the can 48 (FIG. 2) is contiguously sealed at the upper lip of the can. The filling process comprises counter-pressuring the empty can with $CO_2$, discharging a specific amount of beverage into the can in such a way as to avoid foaming and snifting residual at the top of the can, prior to adding the lid.

With continued reference to FIG. 1, once the filling and lid placement steps have taken place in respect to a can 48 above a given lift platform cylinder assembly 14, the associated conventional lock lever 24 remains in its active position until leg 38 is caused to rotate counter-clockwise (as viewed in FIG. 1) 90 degrees by reason of engagement of leg 38 with a stationary cam 46. This moves the lock lever 24 from the first position illustrated at the left in FIG. 1 to the second position illustrated at the left in FIG. 1.

Figure 2:
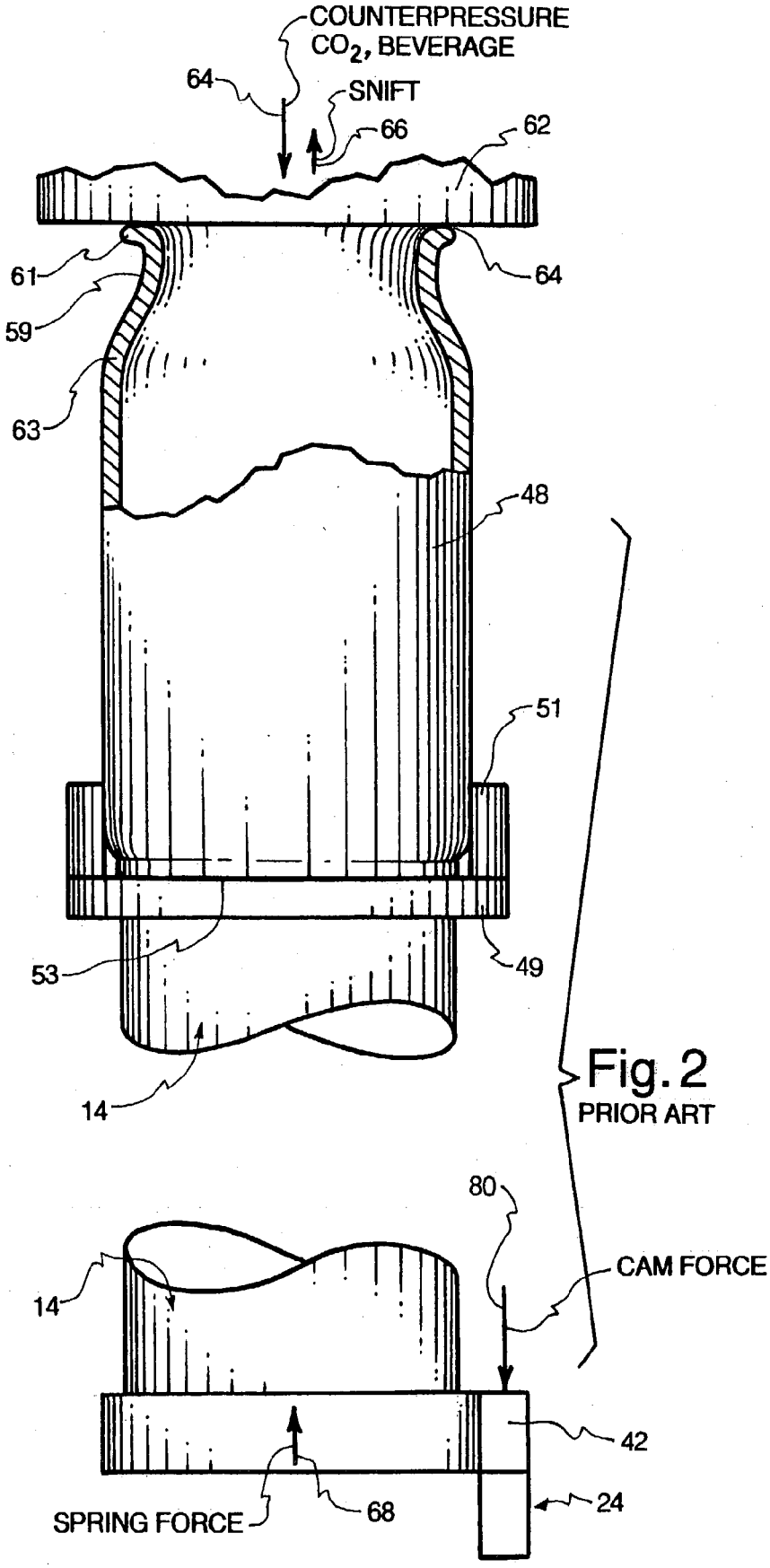
Fig. 2 PRIOR ART
FIG. 2 is a diagrammatic presentation of the forces imposed upon a can being filled and forces which sometimes exist when the platform lift cylinder upon which the can is placed is subjected to certain cam forces and certain spring load forces.

Reference is now made to FIG. 2 which also is directed toward the prior art described above in conjunction with FIG. 1. FIG. 2 is a diagrammatic illustration showing the various forces described above. The platform lift cylinder assembly 14 has a lift platform 49 superimposed over and secured thereto, with a U-shaped backrest 51 superimposed over the lift platform 49. The bottom 53 of an open-top can 48 is illustrated as resting upon the platform 49 and contiguously against the interior surface of the backrest 51. The can 48 is illustrated as having a necked-down or transitional region 59 near the top thereof, terminating in an upper lip 61. The diameter of the main cylindrical wall 63 is substantially greater than the diameter of the lip 61. The lip 61 is shown as being forcibly contiguous with a conventional sealing rubber or fill seal 62, creating a hermetical sealed interface 64 between the lip 61 and the seal 62. The sealing rubber 62 accommodates introduction therethrough of counter-pressure $CO_2$ and beverage as indicated by arrow 64, and accommodates snifting therethrough as well as indicated by arrow 66.

Arrow 68 illustrates the spring pressure imposed upon the cylinder assembly 14, while arrow 80 illustrates the force sometimes applied to the offset base 42 of the cylinder by the stationary cam 20, explained above in respect to FIG. 1. Below the offset base element 42 of cylinder assembly 14 is illustrated a conventional concentric lock lever 24.

Figure 4:
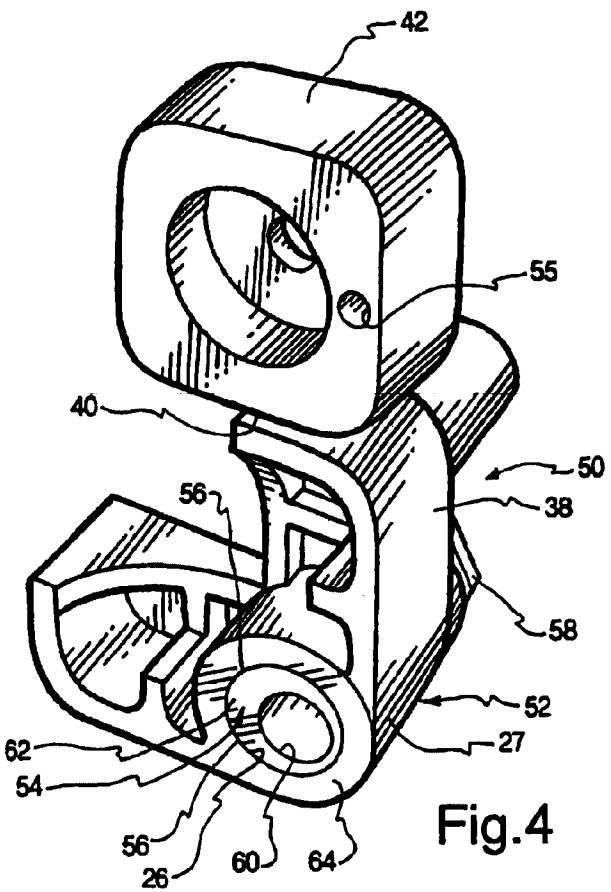
FIG. 4 is a fragmentary perspective, similar to FIG. 3, except showing the eccentric lock lever in its active position providing support to the offset base and to the lift cylinder assembly.
Figure 3:
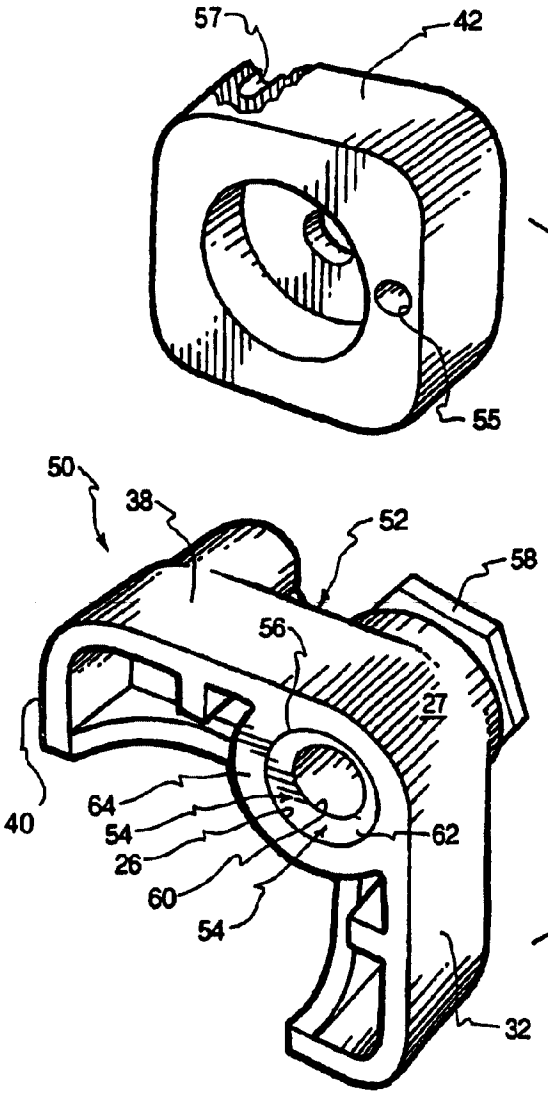
FIG. 3 is a fragmentary perspective of one embodiment of an eccentric lock lever in accordance with the present invention shown in its inactive position away from the offset base of the lift cylinder assembly.
Figures 5, 6:
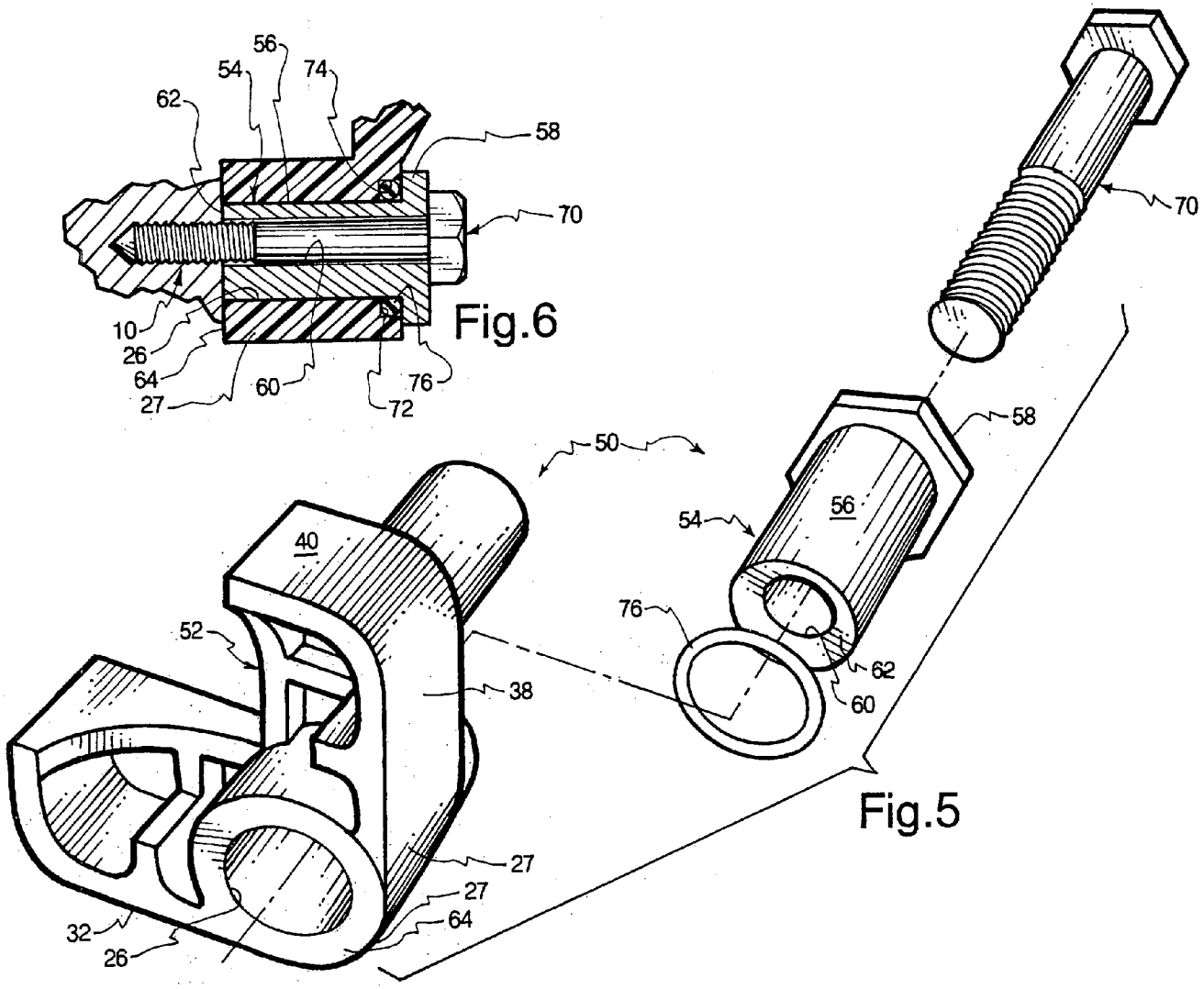
FIG. 5 is an exploded perspective showing the lift lock lever of FIG. 4 in its active position, together with an eccentric bushing or sleeve, an O-ring and a bolt associated with the lock lever.
FIG. 6 shows in cross-section the components of FIG. 5 in their assembled and installed condition.
Figure 7:
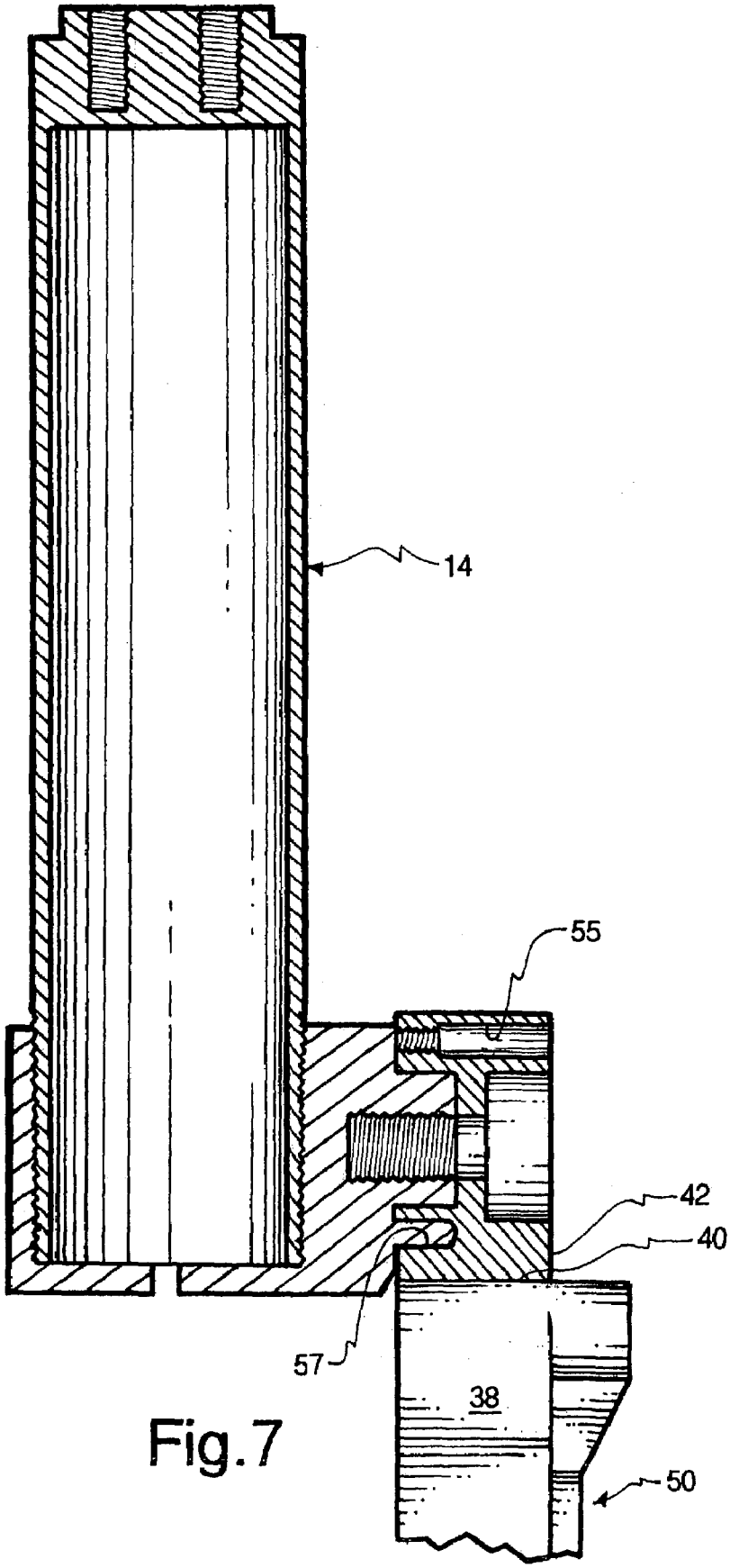
FIG. 7 is a vertical cross-section through the lift cylinder assembly of FIG. 1, showing the eccentric lock lever of FIG. 5 in its active position supporting the offset base of the associated lift cylinder assembly.

Reference is now made to FIGS. 3–5, which illustrate one of several possible embodiments of the present invention, comprising an eccentric replacement lock lever assembly, generally designated 50. The L-shaped configuration and shape of eccentric lock lever 50 is the same as the L-shaped element 24 shown in FIG. 1, although the diameter of the corner aperture 26 could be somewhat different. The L-shaped component, generally designated 52 of the eccentric lock lever assembly 50 may be comprised of rigid, wear resistant and long lasting synthetic resinous material, such as high molecular weight nylon and is preferably formed using commercially available injection molding techniques. The utilization of spaces and ribs is for the purpose of providing adequate strength while using no more material than necessary.

The offset base element 42 of the cylinder assembly 14 is also illustrated in FIGS. 3 and 4, being shown in FIG. 3 with the eccentric lock lever assembly 50 in its inactive counter-clockwise rotated position. Element 42 is contiguous with engagement surface 40 (which comprises an enlarged area), when the lock lever assembly 50 is in the active position shown in FIG. 4, with the eccentric lock lever rotated counter-clockwise through 90 degrees to produce forcible contact between the bottom surface of element 42 and the engagement surface 40. Element 42 is conventional and comprises a through-bore 55, with threads at one end and four corner blind bores 57, for receipt of pins at the base of the cylinder 14, to accommodate the proper assembly and prevent inadvertent rotation.

Aperture or bore 26 of the eccentric lock lever 52 comprises a predetermined diameter for the purpose of snugly receiving an eccentric sleeve or bushing, generally designated 54. See especially FIG. 5. The bushing or sleeve comprises an exterior cylindrical surface 56, the diameter of which is the same or slightly smaller than the diameter of the aperture 26 so that when the cylindrical surface 56 is inserted into the aperture 26, as shown in FIGS. 3 and 4, the fit between the two is snug so that inadvertent rotation does not occur but the forcible manual rotation for the purpose of adjusting the elevation of the engagement surface 40 of eccentric lock lever 50 is accommodated. This rotation may be achieved using a wrench upon the orthogonal head 58 at one end of the eccentric sleeve or bushing 54. Bushing 54 may be formed of any suitable material, including high molecular weight, high strength resinous materials, aluminum, brass, bronze and steel. 41/40 steel, heat-treated, has been found to be suitable.

The eccentric sleeve or bushing 54 comprises an eccentric bore 60. The bushing or sleeve 54 comprises, in respect to the outside cylindrical surface 56 the center line running the length of the eccentric bushing or sleeve 54. The bore 60 comprises a center line which is parallel to but offset from the center line of the cylinder formed by wall 56. Accordingly, the space between the wall defining the bore 60 and the cylindrical wall 56 varies around the circumference of the eccentric bushing or sleeve 54, as shown in FIGS. 3 through 5. The length of the cylindrical surface 56 is slightly longer than the length of the bore 26 so that the flat end surface 62 of the sleeve 54 projects a very short distance beyond the surface 64 of the L-shaped component 52, as shown in FIGS. 3 and 4.

As illustrated in FIG. 5, the eccentric bore 60 receives a bolt 70, when in the assembled position, which position is illustrated in FIG. 6.

The corner 27 of the L-shaped component 52 of the eccentric lock lever assembly 50 comprises a diametrical enlargement of the bore 26 to form groove 72 and shoulder 74. An O-ring 76 is positioned in the groove 72 adjacent to the shoulder 74, in the assembled position illustrated in FIG. 6, with the orthogonal head 58 of the eccentric sleeve or bushing 54 being contiguously positioned against the O-ring 76 as well. The O-ring constricts against inadvertent rotation between the eccentric sleeve 54 and the lock lever 52. In this position, the threaded end of the bolt 70 threadedly engages the machine 10 to hold the assembly in its assembled, operative position, accommodating rotation of the L-shaped component 52 and the eccentric bushing 54 together, without relative rotation between these two components. However, prior to tightening of the bolt 70, with the machine 10 off or idle, the head 58 of the eccentric sleeve or bushing 54 may be rotated with a wrench, for example, in respect to the L-shaped component 52 to reset the elevation for the surface 40 either up or down for such forcible engagement with the lower end of the cylinder assembly 14 as to impose the correct amount of force from the cylinder assembly 14 against the can, within acceptable limits. In this way, each eccentric lock lever is individually adjusted to ensure that the forces imposed upon each can processed through the machine 10 does not cause the necked-down region of the can to buckle or crinkle.

A simulated can comprised of rigid material, either of fixed length or adjustable in length can be used during this adjustment so as to be superimposed upon the platform and to engage the fill seal 62 thereby ensuring that the magnitude of the force imposed upon the can is within acceptable tolerances below the force which will buckle or crinkle the necked-down portion of the can.

In addition, when the machine 10 is shut down and subjected to periodic maintenance, each eccentric bushing 54 may again be rotated in one direction or the other to bring the elevation of engaging surface 40 to the proper location so that acceptable force levels upon the can are achieved at each platform lift cylinder 14.

After the adjustment in the elevation of each engagement surface 40 when the machine 10 is idle, the movement between active and inactive positions for each lock lever assembly 50, when the machine 10 is operating, is such that the bolts 70 and the eccentric bushings 54 remain stationary.

The invention may be embodied in other specific forms without departing from the spirit or essential characteristics thereof. The present-embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. In an automatic beverage machine for filling cans, a platform lift cylinder assembly, a filling head comprising a filling seal and a selectively rotatable lock lever associated with said platform lift cylinder assembly, the lock lever being rotated between active and inactive positions and comprising an L-shaped configuration defining a corner in which a single rotatable eccentric sleeve is disposed, the selective rotation of the eccentric sleeve in respect to the corner of the lock lever vertically changing an axis rotation of the lock lever to thereby change the vertical position of the lock lever including a changing the elevation of a horizontally-disposed support surface at one end of the lock lever when in the active position thereby causing imposition by-the lock lever of a different vertical force within an acceptable controlled tolerance on said associated platform lift cylinder assembly which is transferred to a beverage receiving can to prevent can damage and leakage, eccentric sleeve comprising a one-piece sleeve defining a shaft-receiving eccentric bore, the bore being parallel to but offset from a longitudinal axis of the sleeve being selectively rotatably carried in an aperture in the corner.

2. In the automatic beverage machine for filling cans according to claim 1 wherein the lock lever is comprised of a rigid injection molded synthetic resinous material.

3. In the automatic beverage machine for filling cans according to claim 1 wherein the eccentric sleeve comprises of metal.

4. In the automatic beverage machine for filling cans according to claim 1 wherein the eccentric sleeve comprises a bushing comprising an eccentric passageway through which a rod is adapted to pass.

5. In the automatic beverage machine for filling cans according to claim 1 wherein the support surface comprises an enlarged area.

* * * * *